US011505853B2

(12) United States Patent
Bae

(10) Patent No.: US 11,505,853 B2
(45) Date of Patent: Nov. 22, 2022

(54) HIGH MANGANESE STEEL HAVING SUPERIOR LOW-TEMPERATURE TOUGHNESS AND YIELD STRENGTH AND MANUFACTURING METHOD THEREOF

(71) Applicant: POSCO, Pohang-si (KR)

(72) Inventor: Jin-Ho Bae, Gwangyang-si (KR)

(73) Assignee: POSCO, Pohang-si (KR)

( * ) Notice: Subject to any disclaimer, the term of this patent is extended or adjusted under 35 U.S.C. 154(b) by 131 days.

(21) Appl. No.: 16/472,256

(22) PCT Filed: Dec. 21, 2017

(86) PCT No.: PCT/KR2017/015290
§ 371 (c)(1),
(2) Date: Jun. 21, 2019

(87) PCT Pub. No.: WO2018/117712
PCT Pub. Date: Jun. 28, 2018

(65) Prior Publication Data

US 2019/0323108 A1 Oct. 24, 2019

(30) Foreign Application Priority Data

Dec. 22, 2016 (KR) ..... 10-2016-0176297

(51) Int. Cl.

| | |
|---|---|
| ***C22C 38/04*** | (2006.01) |
| ***C21D 8/02*** | (2006.01) |
| ***C22C 38/06*** | (2006.01) |
| ***C22C 38/20*** | (2006.01) |
| ***C22C 38/22*** | (2006.01) |
| ***C22C 38/38*** | (2006.01) |
| ***C22C 38/42*** | (2006.01) |
| ***C22C 38/44*** | (2006.01) |
| ***C22C 38/58*** | (2006.01) |

(52) U.S. Cl.
CPC ..... *C22C 38/04* (2013.01); *C21D 8/0226* (2013.01); *C22C 38/06* (2013.01); *C22C 38/20* (2013.01); *C22C 38/22* (2013.01); *C22C 38/38* (2013.01); *C22C 38/42* (2013.01); *C22C 38/44* (2013.01); *C22C 38/58* (2013.01)

(58) Field of Classification Search
CPC ..... C21D 6/001; C21D 6/002; C21D 6/004; C21D 6/005; C21D 8/02; C21D 8/0205; C21D 8/0226; C21D 9/46; C22C 38/00; C22C 38/04; C22C 38/06; C22C 38/08; C22C 38/12; C22C 38/16; C22C 38/20; C22C 38/22; C22C 38/38; C22C 38/42; C22C 38/44; C22C 38/58
See application file for complete search history.

(56) References Cited

U.S. PATENT DOCUMENTS

| | | | | |
|---|---|---|---|---|
| 2008/0035248 | A1 | 2/2008 | Cugy et al. | |
| 2011/0308673 | A1* | 12/2011 | Schneider | C21D 6/005 420/72 |
| 2013/0295409 | A1 | 11/2013 | Chin et al. | |
| 2015/0078955 | A1* | 3/2015 | Bouzekri | C22C 38/58 420/73 |
| 2015/0354037 | A1 | 12/2015 | Lee et al. | |
| 2016/0319407 | A1* | 11/2016 | Lee | C22C 38/20 |
| 2017/0362675 | A1 | 12/2017 | Lee et al. | |

FOREIGN PATENT DOCUMENTS

| | | | | |
|---|---|---|---|---|
| CN | 102822371 | A | 12/2012 | |
| CN | 103370434 | A | 10/2013 | |
| CN | 106222554 | A | 12/2016 | |
| EP | 2 554 699 | A1 | 2/2013 | |
| EP | 2 799 571 | A1 | 11/2014 | |
| EP | 3 088 555 | A1 | 11/2016 | |
| JP | S60-077962 | A | 5/1985 | |
| JP | 2006-299398 | A | 11/2006 | |
| JP | 2016-84529 | A | 5/2016 | |
| JP | 2016-196703 | A | 11/2016 | |
| JP | 2016196703 | A * | 11/2016 | |
| KR | 10-0815717 | A | 3/2008 | |
| KR | 10-2013-0088331 | A | 8/2013 | |
| KR | 10-2015-0075276 | A | 7/2015 | |
| KR | 10-2015-0075305 | A | 7/2015 | |
| KR | 10-2016-0077558 | A | 7/2016 | |
| KR | 10-2016-0077594 | A | 7/2016 | |
| KR | 10-2016-0078664 | A | 7/2016 | |
| KR | 10-2016-0078840 | A | 7/2016 | |
| KR | 10-2016-0078853 | A | 7/2016 | |
| KR | 20160078713 | A * | 7/2016 | |
| WO | WO-2015099363 | A1 * | 7/2015 | C22C 38/04 |
| WO | 2016/105002 | A1 | 6/2016 | |

OTHER PUBLICATIONS

International Search Report dated Mar. 27, 2018 issued in International Patent Application No. PCT/KR2017/015290 (with English translation).
Office Action issued in corresponding Chinese Patent Application No. 201780080193.8 dated Aug. 21, 2020, with English translation.
Office Action issued in corresponding Japanese Patent Application No. 2019-533606 dated Oct. 6, 2020, with English translation.
Extended European Search Report for corresponding European Patent Application No. 17883027.9 dated Nov. 26, 2019.

* cited by examiner

*Primary Examiner* — Jenny R Wu
(74) *Attorney, Agent, or Firm* — Morgan, Lewis & Bockius LLP

(57) ABSTRACT

The present invention relates to a method for manufacturing a high strength and high toughness steel material which is mainly used at an extremely low temperature and used in various parts of ships for LNG transport and LNG fuel vehicles.

2 Claims, No Drawings

HIGH MANGANESE STEEL HAVING SUPERIOR LOW-TEMPERATURE TOUGHNESS AND YIELD STRENGTH AND MANUFACTURING METHOD THEREOF

CROSS-REFERENCE OF RELATED APPLICATIONS

This application is the U.S. National Phase under 35 U.S.C. § 371 of International Patent Application No. PCT/KR2017/015290, filed on Dec. 21, 2017, which in turn claims the benefit of Korean Application No. 10-2016-0176297, filed on Dec. 22, 2016, the entire disclosures of which applications are incorporated by reference herein.

TECHNICAL FIELD

The present disclosure relates to a high strength and high toughness steel material used in various parts of LNG fueled vehicles and ships for LNG transport, and a method for manufacturing the same, and more particularly, to high manganese steel having superior low-temperature toughness and yield strength and a manufacturing method thereof.

BACKGROUND ART

There has been an increased interest in energy sources such as LNG, due to exhaustion of conventional energy sources such as petroleum, and the like. As the consumption of fuels such as natural gas, transferred in a cryogenic liquid state at −100° C. or lower, has increased, demand for manufacturing devices for storing and transferring such fuels and materials of such devices have been increased.

In the case of general carbon steel, toughness of the material may rapidly degrade in the cryogenic state, such that the problem of fracture of the material may occur even by small external impact. To address the problem, materials having excellent impact toughness even in a low temperature have been used. Representative materials may be an aluminum alloy, austenitic stainless steel, 35% invar steel, 9% Ni steel, and the like.

However, there may be the problem in which prices of such materials are high as a content of nickel is high. Thus, it has been necessary to develop a steel material having a low manufacturing price and excellent low temperature toughness.

There may be limitation in use of a general carbon steel product because, when a use temperature decreases, yield strength may rapidly increase, such that toughness may greatly degrade. Also, stainless steel, a representative material having excellent toughness, has low yield strength, and thus, it may not be suitable to use stainless steel as a structural member.

Meanwhile, the method for making a material having high low temperature toughness is to allow the material to have a stable austenite structure at a low temperature. In the case of a ferrite structure, a ductility-brittleness transition phenomenon may appear at a low temperature, such that toughness may rapidly decrease in a low temperature brittleness region, whereas an austenite structure does not have a ductile-brittle transition phenomenon even in an extremely low temperature and has high low temperature toughness. That is because, unlike ferrite, as austenite has low yield strength at a low temperature, plastic deformation may easily occur such that impacts caused by external deformation may be absorbed.

A representative element which may increase austenite stability in a low temperature is nickel, but a price of nickel maybe expensive, which is a disadvantage.

PRIOR ART (Reference 1) Japanese Laid-Open Patent Publication So No. 60-077962

DISCLOSURE

Technical Problem

An aspect of the present disclosure is to provide high manganese steel having superior low temperature toughness and yield strength.

Another aspect of the present disclosure is to provide a method for manufacturing high manganese steel having superior low temperature toughness and yield strength.

Technical Solution

According to an aspect of the present disclosure, high manganese steel having superior low-temperature toughness and yield strength is provided, the high manganese steel comprising, in terms of wt %, C: 0.3 to 0.6%, Mn: 20 to 25%, Mo: 0.01 to 0.3%, Al: 3% or less (including 0%), Cu: 0.1 to 3%, P: 0.06% or less (including 0%) and S: 0.005% or less (including 0%), and including at least one selected from among Cr: 8% or less (including 0%) and Ni: 0.1 to 3%, and including other inevitable impurities and the remainder being Fe, wherein said Mo and P satisfy the following Relational Expression (1): [Relational Expression 1] $1.5 \leq 2*(Mo/93)/(P/31) \leq 9$, and a microstructure comprises austenite having a grain size of 50 μm or less.

According to another aspect of the present disclosure, a method of manufacturing high manganese steel having superior low temperature toughness and yield strength is provided, the method comprising reheating a slab at 1000 to 1250° C., the slab comprising, by wt %, 0.3 to 0.6% of C, 20 to 25% of Mn, 0.01 to 0.3% of Mo, 3% or less of Al, including 0%, 0.1 to 3% of Cu, 0.06% or less of P, including 0%, and 0.005% or less of S, including 0%, one or more selected from between 8% or less of Cr, including 0%, and 0.1 to 3% of Ni, and other inevitable impurities and a remainder of Fe, where Mo and P satisfy the following Relational Expression (1), [Relational Expression 1], $1.5 \leq 2*(Mo/93)/(P/31) \leq 9$; obtaining a hot-rolled steel sheet by primarily hot-rolling the heated slab, terminating the primary hot-rolling at 980 to 1050° C., secondarily hot-rolling the hot-rolled slab in a non-recrystallization region at a rolling reduction rate of 3% or less, and terminating the secondary hot-rolling at 800 to 960° C.; water-cooling the hot-rolled steel sheet to a cooling terminating temperature of 350 to 600° C.; and coiling the cooled hot-rolled steel sheet.

Advantageous Effects

According to the present disclosure, high manganese steel having an impact toughness value of 100 J or higher, measured by a charpy impact test at −196° C., and room temperature yield strength of 380 MPa or higher may be provided.

BEST MODE FOR INVENTION

The present disclosure will be described in greater detail.

The present disclosure is based on the result obtained by research and experimentation on high manganese steel having superior low temperature toughness and yield strength, and the main ideas are as follows.

1) In a steel composition, particularly, contents of manganese and carbon may be controlled.

Accordingly, a highly uniform and stable austenite phase may be secured.

In a steel composition, particularly, appropriate contents of Cr (selectively added), a carbonitride formation element, and of Cu, Al, and the like, solid solution strengthening elements, may be added.

Accordingly, yield strength may increase.

3) Among manufacturing conditions, a hot-rolling condition may be properly controlled.

Accordingly, strength and impact toughness may increase.

In the description below, austenitic high manganese steel used in an extremely low temperature will be described according to an aspect of the present disclosure.

High manganese steel having superior low-temperature toughness and yield strength according to an aspect of the present disclosure may include, by wt %, 0.3 to 0.6% of C, 20 to 25% of Mn, 0.01 to 0.3% of Mo, 3% or less of Al, including 0%, 0.1 to 3% of Cu, 0.06% or less of P, including 0%, and 0.005% or less of S, including 0%, one or more selected from between 8% or less of Cr, including 0%, and 0.1 to 3% of Ni, and other inevitable impurities and a remainder of Fe, and Mo and P may satisfy Relational Expression 1 below.

$$1.5 \leq 2*(Mo/93)/(P/31) \leq 9 \quad \text{[Relational Expression 1]}$$

A microstructure may be formed of austenite having a grain size of 50 μm or less.

A steel composition and composition ranges will be described.

Carbon (C): 0.3 to 0.6 wt % (hereinafter, referred to as %)

C is an element which may be required to stabilize austenite in steel and to secure strength by being solute to steel. However, when a content of Cis less than 0.3%, austenite stability may be insufficient, such that ferrite or martensite may be formed, which may degrade low temperature toughness. When a content of C exceeds 0.6%, carbide may be formed such that a surface defect may occur, and toughness may degrade. Thus, it may be preferable to control a content of C to be 0.3 to 0.6%.

A more preferable content of C may be 0.35 to 0.55%, and an even more preferable content of C may be 0.4 to 0.5%.

Manganese (Mn): 20 to 25%

Mn is an important element which may stabilize an austenite structure. To secure low temperature toughness, the formation of ferrite should be prevented, and austenite stability may need to be increased. Thus, in the present disclosure, a minimum content of Mn maybe 20% or higher. When a content of Mn is less than 20%, a α'-martensite phase may be formed, which may decrease low temperature toughness. When a content of Mn exceeds 25%, manufacturing costs may greatly increase, and internal oxidation may excessively occur during heating in a hot-rolling process in terms of process such that the problem of degradation of surface quality may be caused. Thus, it may be preferable to control a content of Mn to be 20 to 25%.

A more preferable content of Mn may be 21 to 24%, and an even more preferable content of Mn may be 22 to 24%.

Molybdenum (Mo): 0.01 to 0.3%

Mo may be effective for improving impact toughness by generating an effect of preventing P grain boundary segregation by forming a Fe—Mo—P compound. To this end, a content of Mo may need to be 0.01% or higher. However, as Mo is an expensive element, it may be preferable to control a content of Mo to be 0.3% or less to prevent a decrease of impact energy caused by an increase of strength due to the formation of Mo carbonitride.

Aluminum (Al): 3% or less (including 0%)

Al has an effect of, by increasing stacking fault energy, enabling plastic deformation by facilitating movement of dislocation in a low temperature. When a content of Al exceeds 3%, manufacturing costs may greatly increase, and cracks may be created in a consecutive casting process in terms of process, which may cause the problem of degradation of surface quality. Thus, it may be preferable to control a content of Al to be 3% or less (including 0%). Amore preferable content of Al may be 0 to 2%, and an even more preferable content of Al may be 0.5 to 1.5%.

Copper (Cu):0.1 to 3%

Cu maybe required to increase strength by being solute in steel.

When a content of Cu is less than 0.1%, it may be difficult to obtain an effect of addition of Cu. When a content of Cu exceeds 3%, cracks may easily be created on a slab. Thus, it may be preferable to control a content of Cu to be 0.1 to 3%.

A more preferable content of Cu may be 0.5 to 2.5%, and an even more preferable content of Cu may be 0.5 to 2%.

Phosphorus (P): 0.06% or less (including 0%)

P is an element which may be inevitably added when manufacturing steel. When P is added, P may be segregated in a central portion of a steel sheet, and may be used as a crack initiation point or a crack growth path. It may be preferable to control a content of P to be 0% theoretically, but in terms of manufacturing process, P may be inevitably included as impurities. Thus, it may be important to control an upper limit content. In the present disclosure, it may be preferable to control an upper limit content of P to be 0.06%.

Sulfur (S): 0.005% or less (including 0%)

S is an impurity element present in steel. S may be combined with Mn, and the like, and may form a non-metal inclusion, which may degrade toughness of steel. Thus, it may be preferable to decrease a content of S as possible, and thus, it may be preferable to control an upper limit content of S to be 0.005%.

In the steel composition, Mo and P may satisfy Relational Expression (1) below.

$$1.5 \leq 2*(Mo/93)/(P/31) \leq 9 \quad \text{[Relational Expression (1)]}$$

Relational Expression (1) is to prevent grain boundary segregation of P. When a value of Relational Expression (1) is less than 1.5, the effect of preventing P grain boundary segregation by forming an Fe—Mo—P compound may not be sufficient. When a value of Relational Expression (1) exceeds 9, strength may increase by formation of Mo carbonitride, which may decrease impact energy.

One or more selected from between 8% or less of Cr (including 0%) and 0.1 to 3% of Ni In addition to the above-described composition, one or more selected from between 8% or less of Cr (including 0%) and 0.1 to 3% of Ni may be included.

Chromium (Cr): 8% or less (including 0%)

An appropriate range of a content of Cr may stabilize austenite such that impact toughness at a low temperature may improve, and Cr may be solute in austenite and may increase strength of a steel material. Cr is also an element which may improve corrosion-resistance of a steel material. Cr, however, is a carbide-forming element, which may form carbides at an austenite grain boundary and may decrease low temperature impact. Thus, in the present disclosure, it may be preferable to determine a content of Cr in consideration of relationships with C and other elements to be included. When a content of Cr exceeds 8%, it may be difficult to effectively prevent the formation of carbide in an austenite grain boundary, and accordingly, impact toughness at a low temperature may decrease. Thus, it may be preferable to control a content of Cr to be 0 to 8%. A more preferable content of Cr may be 0 to 6%, and an even more preferable content of Cr may be 0 to 5%.

Nickel (Ni): 0.1 to 3%

Ni is an element which may be required to stabilize austenite in steel. When a content of Ni is less than 0.1%, it may be difficult to obtain an effect of addition of Ni. When a content of Ni exceeds 3%, there maybe the problem of an increase in manufacturing costs.

Thus, it may be preferable to control a content of Ni to be 0.1 to 3%.

A more preferable content of Ni may be 0.5 to 2.5%, and an even more preferable content of Ni may be 0.5 to 2%.

High manganese steel according to the present disclosure may have a microstructure formed of austenite having a grain size of 50 μm or less.

When the grain size exceeds 50 μm, there may be the problem of decrease of yield sensitivity and impact energy.

High manganese steel in the present disclosure may have an impact toughness value of 100 J or higher, measured by a charpy impact test at −196° C., and room temperature yield strength of 380 MPa or higher.

In the description below, a method of manufacturing high manganese steel having superior low temperature toughness and yield strength will be described according to the present disclosure.

The method of manufacturing high manganese steel having superior low temperature toughness and yield strength may include reheating a slab at 1000 to 1250° C., the slab comprising, by wt %, 0.3 to 0.6% of C, 20 to 25% of Mn, 0.01 to 0.3% of Mo, 3% or less of Al, including 0%, 0.1 to 3% of Cu, 0.06% or less of P, including 0%, and 0.005% or less of S, including 0%, one or more selected from between 8% or less of Cr, including 0%, and 0.1 to 3% of Ni, and other inevitable impurities and a remainder of Fe, where Mo and P may satisfy the following Relational Expression (1), $1.5 \leq 2*(Mo/93)/(P/31) \leq 9$, obtaining a hot-rolled steel sheet by primarily hot-rolling the heated slab, terminating the primary hot-rolling at 980 to 1050° C., secondarily hot-rolling the hot-rolled slab in a non-recrystallization region at a rolling reduction rate of 3% or less, and terminating the secondary hot-rolling at 800 to 960° C., water-cooling the hot-rolled steel sheet to a cooling terminating temperature of 350 to 600° C., and coiling the cooled hot-rolled steel sheet.

Reheating Slab

Before hot-rolling, a slab may be reheated at 1000 to 1250° C.

The slab reheating temperature may be important in the present disclosure. The slab reheating process maybe performed for a casting structure and segregation thereof, and solid solution and homogenization of secondary phases, formed in a slab manufacturing process. When the reheating temperature of a slab is less than 1000° C., deformation resistance may increase during hot-rolling as homogenization is insufficient or a temperature of a heating furnace is too low. When the reheating temperature exceeds 1250° C., surface quality may be deteriorated. Thus, it may be preferable to control the slab reheating temperature to be 1000 to 1250° C.

Hot-Rolling

A hot-rolled steel sheet maybe obtained by primarily hot-rolling the heated slab, terminating the primary hot-rolling at 980 to 1050° C., secondarily hot-rolling the hot-rolled slab in a non-recrystallization region at a rolling reduction rate of 3% or less, and terminating the secondary hot-rolling at 800 to 960° C.

It may be important to terminate the primary rolling of the heated slab at 980 to 1050° C., and it may be important to terminate the secondary rolling at 800 to 960° C. after rolling the slab in a non-recrystallization region at a rolling reduction rate of 3% or less.

That is because, if the rolling finish temperature is too high, a final structure may be coarse such that desired strength and impact toughness may not be obtained. If the rolling finish temperature is too low, there may be the problem of facility load in a finish rolling device. Also, if a reduction amount of a non-recrystallization region is too high, impact toughness may decrease. Thus, it may be preferable to control the rolling finish temperature to be 3% or less.

Cooling and Coiling

After finishing the hot-rolling, the hot-rolled steel sheet may be water-cooled, and may be coiled at 350 to 600° C. When the cooling terminating temperature is higher than 600° C., surface quality may degrade, and coarse carbide may be formed such that toughness may decrease. When the cooling terminating temperature is less than 350° C., a large amount of cooling water maybe required during the coiling, and a coiling force during the coiling may greatly increase.

The high manganese steel manufactured by the method of manufacturing high manganese steel in the present disclosure may have an impact toughness value of 100 J or higher, measured by a charpy impact test at −196° C., and yield strength at a room temperature of 380 MPa or higher preferably.

Mode for Invention

In the description below, the present disclosure will be described in greater detail according to an example embodiment. The example embodiment below is merely an example for describing the present disclosure in detail, and may not limit the scope of rights of the present disclosure.

Embodiment

An inventive steel having a chemical composition as in Table 1 below was manufactured as a slab by a consecutive casting method, and the slab was hot-rolled as in Table 2, thereby manufacturing a steel material.

A grain size, room temperature yield strength, and an impact energy value of the steel material manufactured as above were examined, and the results were listed in Table 2.

TABLE 1

| Note | Steel Type | C | Si | Mn | P | S | TAl | Cr | Ni | Cu | Mo | 2 * (Mo/92)/(P/31) |
|---|---|---|---|---|---|---|---|---|---|---|---|---|
| Inventive Material | A1 | 0.45 | 0 | 22 | 0.015 | 0.001 | 1 | 0 | 1 | 0.5 | 0.1 | 4.5 |
| | A2 | 0.45 | 0 | 22 | 0.015 | 0.001 | 1 | 0 | 2 | 0.5 | 0.12 | 5.4 |
| | A3 | 0.45 | 0 | 22 | 0.015 | 0.001 | 1 | 1 | 1 | 1 | 0.11 | 4.9 |
| | A4 | 0.45 | 0 | 22 | 0.015 | 0.001 | 1 | 2 | 0.5 | 2 | 0.13 | 5.8 |
| | A5 | 0.45 | 0 | 24 | 0.015 | 0.001 | 1 | 3 | 0 | 0.5 | 0.1 | 4.5 |
| | A6 | 0.45 | 0 | 24 | 0.015 | 0.001 | 0 | 3 | 0 | 0.5 | 0.1 | 4.5 |
| | A7 | 0.45 | 0 | 24 | 0.015 | 0.001 | 0 | 6 | 0 | 0.5 | 0.14 | 6.3 |
| Comparative Material | B1 | 0.45 | 0 | 22 | 0.015 | 0.001 | 1 | 0 | 0 | 0 | 0.03 | 1.3 |
| | B2 | 0.45 | 0 | 24 | 0.015 | 0.001 | 0 | 0 | 0 | 0 | 0.06 | 1.4 |
| | B3 | 0.45 | 0 | 26 | 0.015 | 0.001 | 0 | 0 | 0 | 0 | 0.02 | 0.9 |
| | B4 | 0.45 | 1 | 26 | 0.015 | 0.001 | 0 | 0 | 0 | 0 | 0.02 | 0.9 |
| | B5 | 0.45 | 2 | 26 | 0.015 | 0.001 | 0 | 0 | 0 | 0 | 0.03 | 1.3 |
| | B6 | 0.45 | 0 | 24 | 0.03 | 0.001 | 0 | 3 | 0 | 0 | 0.02 | 0.4 |

TABLE 2

| Note | Steel Type | Heating temperature (° C.) | Primary Rolling Terminating Temperature (° C.) | Non-Recrystallization Region (%) | Secondary Rolling Terminating Temperature (° C.) | Coiling Temperature (° C.) | Grain Size (μm) | Room Temperature Yield Strength (MPa) | Impact Energy (J, @−196° C.) |
|---|---|---|---|---|---|---|---|---|---|
| Inventive Material | A1 | 1205 | 1023 | 1.0 | 932 | 440 | 25 | 380 | 133 |
| | A2 | 1204 | 1011 | 1.5 | 920 | 418 | 27 | 398 | 135 |
| | A3 | 1098 | 1012 | 1.5 | 900 | 435 | 29 | 397 | 126 |
| | A4 | 1094 | 1013 | 2.0 | 910 | 418 | 21 | 414 | 119 |
| | A5 | 1210 | 1023 | 1.0 | 913 | 443 | 19 | 405 | 115 |
| | A6 | 1221 | 998 | 2.0 | 914 | 442 | 27 | 446 | 124 |
| | A7 | 1084 | 996 | 2.1 | 921 | 431 | 29 | 481 | 146 |
| Comparative Material | B1 | 1235 | 1018 | 0 | 923 | 467 | 33 | 349 | 119 |
| | B2 | 1121 | 1021 | 0 | 918 | 442 | 29 | 387 | 62 |
| | B3 | 1095 | 1032 | 0 | 935 | 402 | 29 | 380 | 29 |
| | B4 | 1201 | 1037 | 1.1 | 940 | 471 | 27 | 427 | 31 |
| | B5 | 1086 | 1009 | 0 | 910 | 340 | 28 | 468 | 35 |
| | B6 | 1082 | 1015 | 0 | 901 | 341 | 26 | 439 | 90 |
| | A6 | 1212 | 1011 | 6 | 893 | 421 | 18 | 496 | 65 |
| | A2 | 1098 | 1024 | 1 | 928 | 615 | 28 | 387 | 45 |

As indicated in Table 2, the inventive steel manufactured by the manufacturing method of the present disclosure using inventive steel satisfying the composition ranges of the present disclosure had high strength and high toughness after rolling.

While exemplary embodiments have been shown and described above, the scope of the present disclosure is not limited thereto, and it will be apparent to those skilled in the art that modifications and variations could be made without departing from the scope of the present invention as defined by the appended claims.

The invention claimed is:

1. High manganese steel, consisting of:

by wt %, 0.3 to 0.45% of C, 20 to 25% of Mn, 0.01 to 0.14% of Mo, 3% or less of Al, including 0%, 0.1 to 3% of Cu, 0.06% or less of P, excluding 0%, and 0.005% or less of S, including 0%, one or more selected from between 8% or less of Cr, including 0%, and 0.1 to 3% of Ni, and other inevitable impurities and a remainder of Fe, wherein Mo and P satisfy the following Relational Expression (1), $$4.5 \leq 2*(Mo/93)/(P/31) \leq 9 \quad \text{[Relational Expression 1]}$$

where a microstructure comprises austenite having a grain size of 19 μm to 29 μm, and wherein the high manganese steel has an impact toughness value of 115 J to 146 J, measured by a charpy impact test at −196° C., wherein the high manganese steel has room temperature yie;d strenght of 380 MPa to 481 MPa.

2. A method of manufacturing the high manganese steel as recited in claim 1, the method comprising:

reheating a slab at 1000 to 1250° C., the slab consisting of, by wt %, 0.3 to 0.6% of C, 20 to 25% of Mn, 0.01 to 0.3% of Mo, 3% or less of Al, including 0%, 0.1 to 3% of Cu, 0.06% or less of P, including 0%, and 0.005% or less of S, including 0%, one or more selected from between 8% or less of Cr, including 0%, and 0.1 to 3% of Ni, and other inevitable impurities and a remainder of Fe, where Mo and P satisfy the following Relational Expression (1), $$1.5 \leq 2*(Mo/93)/(P/31) \leq 9 \quad \text{[Relational Expression 1]}$$

obtaining a hot-rolled steel sheet by primarily hot-rolling the heated slab, terminating the primary hot-rolling at 980 to 1050° C., secondarily hot-rolling the hot-rolled slab in a non-recrystallization region at a rolling reduction rate of 3% or less, and terminating the secondary hot-rolling at 800 to 960° C.;

water-cooling the hot-rolled steel sheet to a cooling terminating temperature of 350 to 600° C.; and coiling the cooled hot-rolled steel sheet; thereby producing the high manganese steel of claim 1.

* * * * *